United States Patent [19]

Prais et al.

[11] Patent Number: 4,699,291

[45] Date of Patent: Oct. 13, 1987

[54] PACKAGE ASSEMBLY FOR AN ARTICLE

[75] Inventors: Alfred W. Prais, Hewitt; Frank A. Augello, Basking Ridge, both of N.J.

[73] Assignee: Becton, Dickinson and Company, Franklin Lakes, N.J.

[21] Appl. No.: 915,349

[22] Filed: Oct. 6, 1986

[51] Int. Cl.[4] ..... B65D 45/32

[52] U.S. Cl. ..... 220/319; 206/461; 206/467; 206/1.5; 220/4 E; 220/4 F

[58] Field of Search ..... 206/1.5, 461, 467; 220/4 E, 4 F, 319

[56] References Cited

U.S. PATENT DOCUMENTS

| | | | |
|---|---|---|---|
| 239,225 | 3/1881 | Claussen | 220/4 E |
| 816,338 | 3/1906 | Kimsey | 220/319 |
| 1,921,015 | 8/1933 | Young | 220/4 E |
| 2,681,142 | 6/1954 | Cohen | 220/4 E |
| 2,784,675 | 3/1957 | Farrell | 220/319 |
| 3,217,867 | 11/1965 | Harris | 206/468 |
| 3,940,008 | 2/1976 | Flanders | 220/319 |
| 4,033,452 | 7/1977 | Therrien | 206/0.83 |

FOREIGN PATENT DOCUMENTS

| | | | |
|---|---|---|---|
| 2321800 | 11/1973 | Fed. Rep. of Germany | 220/4 E |

*Primary Examiner*—Joseph Man-Fu Moy
*Attorney, Agent, or Firm*—Richard J. Rodrick

[57] ABSTRACT

A package assembly for an article comprises first and second housing portions each having a flange around a periphery thereof. The flanges are positioned adjacent to and in engagement with each other. The housing portions together define a compartment. An article is included within the compartment. A removable securing tube is positioned on the flanges for causing positive engagement therebetween to thereby maintain the housing portions together. Retaining dimples or like detents are included on either flange for maintaining the securing tube in position over the flanges.

10 Claims, 4 Drawing Figures

PACKAGE ASSEMBLY FOR AN ARTICLE

BACKGROUND OF THE INVENTION

1. Field of the Invention

The present invention relates to a packaged article, and more particularly, concerns a package assembly for an article which is sterilized after being packaged.

2. Background Description

It is common and acceptable practice to pre-package medical articles prior to sterilization. Many medical products such as needles, syringes, catheters, cannulae and other devices normally intended for use in or on the body, or for use in a sterile environment, are required to be sterilized. If any of the aforementioned devices or products are intended for multiple uses, sterilization is usually performed by autoclaving techniques. However, many of these products are intended for one-time use and are disposable thereafter. These disposable, sterile products are tyically packaged by the manufacturer, and then the packaged articles or products are then sterilized in bulk. The articles inside the packages are maintained in a sterile condition by virtue of the properties or arrangement of the packaging material. Thus, when the user, such as a nurse, physician, hospital attendant or the like, is ready to make use of the article, the package is normally opened immediately before use of the article contained within.

Since many disposable, sterile articles are packaged individually, there are at least two major considerations, in addition to the ability to permit and maintain sterilization, which should be taken into account with respect to the design of the packaging. The first factor relates to convenience for the user. In this regard, the package, while sealed to maintain sterility, should be simple, straightforward and easy to open, while not disturbing the sterilized article contained inside the package. The second factor relates to manufacturing operations and cost. Clearly since disposable medical articles are frequently packaged individually, the cost of the materials and labor for the packaging could become quite significant. Therefore, inexpensive materials, as well as simple, direct techniques for sealing the article inside the package, while not compromising on the quality of the packaged article, are the goals of the manufacturers of these packaged articles.

Sterile, disposable medical products are oftentimes included in a blister package, usually in the form of a rigid tray and removable cover or lid sealed over the tray. The disposable article itself is usually pre-packaged in the tray, and after the lid is sealed onto the tray, the packaged assembly, along with similar packaged assemblies, are sterilized in bulk. The most common technique for sterilization of these disposable medical articles is by ethylene oxide (ETO). While blister packages are quite common, effective to use and open, and are manufactured with cost constraints in mind, some problems, nevertheless, exist. Due to ETO sterilization, the package must be "breathable," i.e., allow ETO gas into package without allowing microorganisms to enter. Also ETO gas should be vented out of the package to keep residuals at acceptable levels. Blister package components may be sealed by a number of different techniques including radio frequency (RF) sealing, staking or the use of snaps. However, these sealing techniques have been known to restrict the movement of the blister package components, and cause warpage of the blister trays during the ETO sterilization procedures. In addition, the package contents are frequently disrupted or displaced upon opening due to uneven seal strength of the blister package components. Snaps are difficult to form in a reliable fashion, and often perform in an inconsistent manner.

Other techniques are known for holding blister trays or components together. For example, a catheter set sold as the MINI-BALLOON TM catheter system by Becton, Dickinson and Company, Franklin Lakes, N.J. employs a polyethylene tube to hold the upper and lower packaging trays together. However, the package trays, together with polyethylene securing tube, are then inserted in a large blister tub which is sealed with a peelable cover for sterilization purposes. It is appreciated that the multiple packaging components not only adds expense and considerable bulk to the packaged product, but requires additional time and manipulation for gaining access to the sterilized product.

Accordingly, improvements are still being sought in packaged assemblies suitable for medical articles which are to be sterilized and maintained in a sterilized condition until use. The present invention is directed to such an improvement which takes into account the two major considerations or goals set forth above for such packaged articles.

SUMMARY OF THE INVENTION

The present invention is a package assembly for an article comprising a first housing portion having a flange around its periphery, and a second housing portion having a flange around a periphery thereof. The flanges are positioned adjacent to and in engagement with each other. The housing portions define a compartment. An article is in the compartment. Removable securing means positioned on the flanges causes positive engagement therebetween to thereby maintain the housing portions together. Detent means maintains the securing means in position on the flanges.

In a preferred embodiment of the present invention, the package assembly for an article comprises a first housing portion and a second housing portion. An outward flange on each housing portion extends around the respective peripheries of the housing portions. The housing portions define an interior compartment. An article is in the compartment. A plurality of spaced-apart retaining dimples is positioned on either flange. A resilient, substantially hollow cylindrical tube has a slot through its wall along the entire longitudinal axis thereof. This tube is removably positioned over the juxtaposed flanges and the retaining dimples. The flanges and dimples extend through the slot. In this fashion, the tube causes positive engagement between the flanges to maintain the housing portions together with the article in the compartment.

In accordance with the principles of the present invention, a package assembly is provided in which the package components are securely and positively closed. Ease of manufacture is a key feature of the present invention, as well as ease and convenience in opening the package assembly for gaining access to the article for use. The number of package components is held to a minimum in order to take cost constraints into account. Further, assembling the package in the manufacturing operation is a straightforward procedure which takes a minimal amount of time to complete. Further, the package assembly of the present invention is amenable to sterilization techniques, including ETO sterilization, simply by inserting the assembly into a pouch or the like. The preferred securing tube for holding the blister trays together not only holds the components securely together, but also allows for expansion during sterilization. The preferred securing tube as part of the present invention is easily removed by hand by the attendant immediately prior to using the packaged article. Further, the packaged assembly of the present invention may be opened in such a convenient way that the contents of the package should not be spilled which could cause damage or contamination. The package described here allows for ETO gas to easily flow into and out of the package. Other features and advantages of the present invention will become more apparent after reading the Detailed Description which follows below.

DETAILED DESCRIPTION

Figure 1:
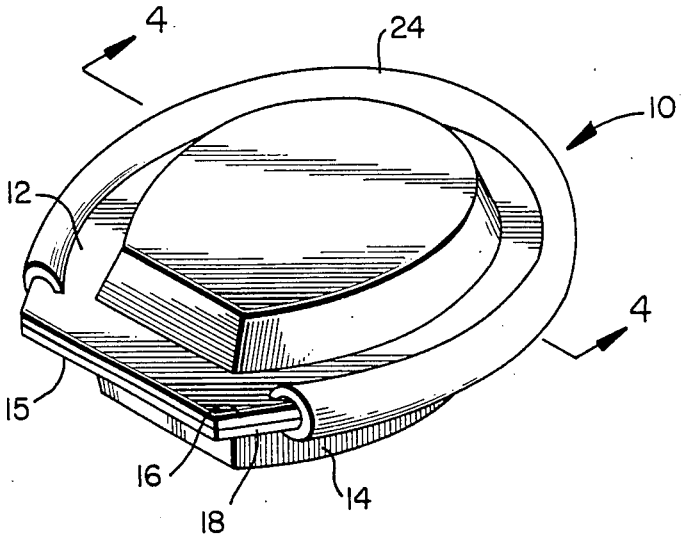
FIG. 1 is a perspective view of an embodiment of a package assembly for a packaged article embodying the features of the present invention.

While this invention is satisfied by embodiments in many different forms, there is shown in the drawings and will herein be described in detail a preferred embodiment of the invention, with the understanding that the present disclosure is to be considered as exemplary of the principles of the invention and is not intended to limit the invention to the embodiment illustrated. The scope of the invention will be measured by the appended claims and their equivalents.

Adverting now to the drawings, there is illustrated a package assembly 10 as it may appear in the form of one embodiment in accordance with the features of the instant invention. It can be seen that assembly 10 is comprised of a first or upper housing portion 12 and a second or lower housing portion 14. These housing portions may be in the form of trays, receptacles or other containers. One preferred form for housing portions 12 and 14 is commonly known as a blister package in which the housing portion includes one or more blister-like sections into which the article or parts of the article may be positioned. In addition, the housing portions of the present package assembly may be in the form of a tray and a cover or lid therefor. Therefore, it is appreciated that housing portions 12 and 14, although preferably in the form of blister packages, may take on many shapes and configurations for holding an article.

Figure 2:
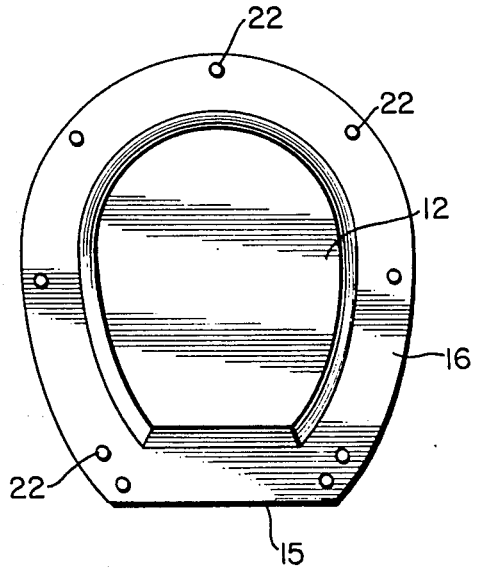
FIG. 2 is a top plan view of the package assembly of FIG. 1 illustrated with the securing tube removed so that the upper housing portion may be seen in its entirety.

In the embodiment being described, housing portions 12 and 14 are substantially circular in cross-section, as more clearly seen in FIGS. 1 and 2. However, an edge 15 of the housing portions is relatively straight as opposed to the remaining arcuate shape of the housing portions. Straight edge 15 is a relatively small portion of the periphery of the housing portions and is included to facilitate the assembly and subsequent removal of the securing tube which holds the housing portions together.

It can be seen in the drawings that first housing portion 12 includes an outwardly extending flange 16 extending around substantially the entire periphery thereof. In similar fashion, second housing portion 14 has an outwardly extending flange 18 extending around substantially the entire periphery of the second housing portion. Flanges 16 and 18 are substantially flat or planar and lie in a sustantially flat plane around the respective peripheries of the housing portions. It is preferred that flanges 16 and 18 be integrally formed with the first and second housing portions, respectively, so that the flanges and the housing portions may be made from the same material in an economic manufacturing operation, such as thermoforming. It is preferred that flanges 16 and 18 be of the same general shape and width around the peripheries of the first and second housing portions so that, when the housing portions are placed together, as seen in the drawings, the flanges are in surface-to-surface juxtaposition with each other in coextensive fashion.

Figure 4:
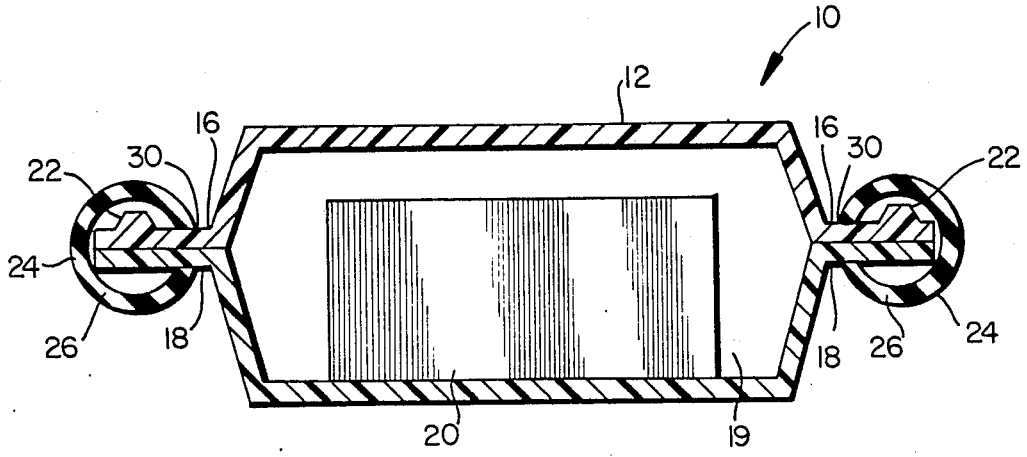
FIG. 4 is a cross-sectional view taken along line 4—4 of the embodiment of FIG. 1.

When housing portion 12 is positioned with respect to housing portion 14, wherein the respective flanges are in mating engagement with each other, an interior compartment 19 is formed. Prior to mating the first and second housing portions together, one or more articles 20 are positioned to be maintained within compartment 20 in the final package. The preferred package assembly of the present invention is desirably suited to permit and maintain sterilization of the articles within the package. To that end, article 20 is preferably a medical article, and may be in many different forms or shapes. Although article 20 as illustrated in FIG. 4 is shown in block-like configuration, such representation is merely for illustrative purposes only. It is also preferred that one or more of the respective housing portions may include shaped contours for defining a compartment to hold one or more articles of selected shapes, thereby minimizing the total amount of space that the housing portions require. Once article 20 is positioned within compartment 19, and insofar as the article is suitable for sterilization techniques and subsequent storage and shipment, it is also a feature of the present invention to maintain the article within the compartment after assembly until the article is ready for use.

Along these lines, it can be seen in the drawings that flange 16 has a plurality of spaced-apart retaining dimples 22 protruding from the surface of that flange. Dimples 22 are preferably in the form of outwardly protruding detents, and are spaced around the periphery of the flange. However, for purposes of the present invention, dimples 22 need not be individualized or separated as illustrated in the drawings, but may be in the form of a continuous bump or ridge slightly inwardly spaced from the outer most edge of flange 16. Other configurations, shapes or locations of the retaining dimples may also be employed. Further, it is understood that dimples 22 may be on the surface of flange 16 or on flange 18 around second housing portion 14. It is also within the purview of the present invention to include dimples or the like on both flanges, if desired.

In order to hold together the two separate housing portions, a securing tube 24 is provided. It is preferred that tube 24 be resilient and substantially cylindrically shaped, although other shapes may be employed. Tube 24 is preferably hollow with a lumen 25 extending completely therethrough and surrounded by a wall 26 defining the body of tube 24. In order to impart resiliency to tube 24, it is preferred that the material out of which the tube is made be a polymeric material such as polyethylene, polypropylene, polyvinyl chloride and the like. As seen more clearly in FIG. 3, tube 24 is preferably elongate in nature and, due to its resiliency and flexibility, is readily bent or curved around its longitudinal axis 28 running through the tube. Extending parallel to longitudinal axis 28 is a slot 30 through wall 26 of the tube, thereby providing a discontinuity in the circular cross-section of the tube. Due the formed nature of the tube, and particularly when the tube is formed of polymeric material such as polyethylene, a spring-like resiliency is imparted to the slotted wall of the tube. Thus, the walls on either side of the slot tend to close-in toward each other thereby closing up the slot due to the spring-like characteristics inherent in this construction.

Figure 3:
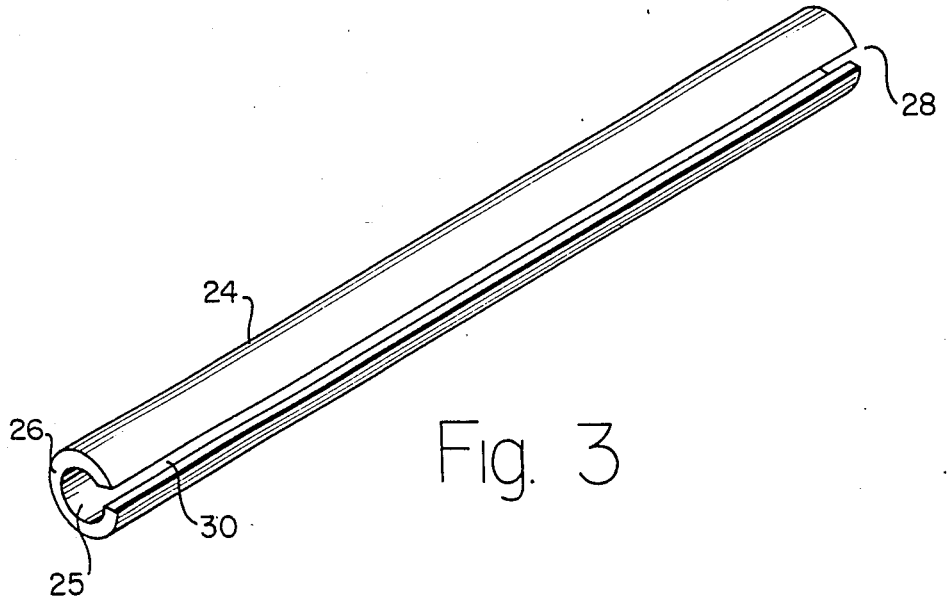
FIG. 3 is a perspective view of the preferred embodiment of the securing tube as part of the package assembly of the present invention.

As seen particularly in FIGS. 1 and 4, taken in conjunction with FIG. 3, tube 24 has been positioned over flanges 16 and 18. Tube 24 has been arcuately bent to assume the contour of the periphery of the respective flanges. Flanges 16 and 18, as well as retaining dimples 22 extend through slot 30 of the tube. The spring-like resiliency of the slotted wall of the tube provides a biasing force, in compression, to cause positive engagement between flanges 16 and 18. Therefore, tube 24, when properly positioned over the flanges, maintains the housing portions together with article 20 inside compartment 19.

It is preferred for purposes of the present invention that tube 24 extend in continuous fashion around substantially the entire arcuate peripheries of the juxtaposed flanges. However, it is also within the purview of the present invention for one or more separate tubes to be employed, if desired at spaced intervals around the periphery of the flanges in order to hold the two housing portions together. For ease of assembly and subsequent removal of tube 24 from the flanges, it is desired that the tube extend around the curved periphery of the flanges, while not covering straight edge 15 of the flanges.

When it is time for article 20 to be used, access to compartment 19 is gained by removing tube 24 from the flanges. The resilient nature of the tube material allows manual manipulation of the tube so that it may be slid off the flanges. Further, while the dimples help retain tube 24 on the flanges prior to use, the retaining dimples are preferably shaped so that the wall of the tube may be slip or slide over the dimples for removal from the flanges. This arrangement as just described is readily amenable to manual manipulation without disrupting or disturbing the article or contents within compartment 19 of the packaged assembly.

Package assembly 10, such as the embodiment illustrated in FIG. 1, is readily suitable for sterilization procedures, such as ETO sterilization. The package assembly may be placed in a pouch or like container, preferably flexible, which is constructed of materials representing a barrier to entrance of bacteria or microorganisms. However, one or more of the pouch materials preferably has sufficient porosity to permit the sterilization materials to penetrate into the interior of the pouch. Package assembly 10, as illustrated, is normally itself not a bacteria barrier so that its contents may be sterilized in accordance with conventional sterilization procedures. However, due to the nature of securing tube 24 holding the housing portions together, the outer packaging materials into which package assembly 10 may be placed for sterilization and subsequent shipment, may be chosen so as to be inexpensive and to minimize size or bulk.

Thus, the present invention provides a package assembly which includes an article which may be sterilized after being packaged. The package components, including the securing tube, provide a straightforward and inexpensive package, which may be readily opened by the user by hand without disrupting the contents within the package.

What is claimed is:

1. A package assembly for an article comprising:

a first housing portion having an outwardly extending flange around a periphery thereof;

a second housing portion having an outwardly extending flange around a periphery thereof, said flanges being in surface-to-surface juxtaposition with each other and said housing portions defining an interior compartment;

an article in said compartment;

a plurality of spaced-apart retaining dimples on at least one of said flanges; and a resilient, substantially hollow, cylindrical, polymeric tube having a slot through its wall along the entire longitudinal axis thereof, said tube removably positioned over the juxtaposed flanges and the retaining dimples, with the flanges and dimples extending through said slot so that the tube causes positive engagement between the flanges to maintain the housing portions together with the article in said compartment, said tube being sufficiently resilient and retained on the flanges by said dimples so as to be manually removable.

2. The package assembly of claim 1 wherein each flange is integrally formed with, and from the same material as, said respective housing portion.

3. The package assembly of claim 1 wherein each flange extends around substantially the entire periphery of said respective housing portion.

4. The package assembly of claim 3 wherein each flange on the respective first and second housing portions lies in a substantially flat plane.

5. The package assembly of claim 4 wherein said housing portions are substantially circular in cross-section so that said juxtaposed flanges arcuately extend around the peripheries thereof.

6. The package assembly of claim 3 wherein said tube extends in continuous fashion around substantially the entire arcuate peripheries of said juxtaposed flanges.

7. The package assembly of claim 1 wherein said retaining dimples protrude outwardly from the surface of the flange.

8. The package assembly of claim 1 wherein said polymeric material is selected to impart spring-like resiliency to the slotted wall of the tube in order to provide a biasing force to cause positive engagement between said flanges.

9. The package assembly of claim 1 wherein at least one of said housing portions includes shaped contours for defining a compartment to hold an article of a selected shape.

10. A package assembly for an article comprising:

a first housing portion having an outwardly extending flange integrally formed with said housing portion around substantially the entire periphery thereof;

a second housing portion having an outwardly extending flange integrally formed with said housing portion around substantially the entire periphery thereof, said flanges being in surface-to-surface juxtaposition with each other and said housing portions defining an interior compartment;

a plurality of spaced-apart retaining dimples on at least one of said flanges; and a resilient, polymeric, substantially hollow cylindrical tube having a slot through its wall along the entire longitudinal axis thereof, said tube removably positioned on and extending in continuous fashion around substantially the entire peripheries of said flanges, with the flanges and dimples extending through said slot, the slotted wall of said tube having spring-like resiliency to impart a biasing force to cause positive engagement between said flanges to maintain the housing portions together with the article in said compartment.

* * * * *